US009033699B2

(12) United States Patent
Stoia et al.

(10) Patent No.: US 9,033,699 B2
(45) Date of Patent: May 19, 2015

(54) COMBUSTOR

(75) Inventors: Lucas John Stoia, Taylors, SC (US); Patrick Benedict Melton, Horse Shoe, NC (US); James Harold Westmoreland, III, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 776 days.

(21) Appl. No.: 13/294,294

(22) Filed: Nov. 11, 2011

(65) Prior Publication Data

US 2013/0122438 A1 May 16, 2013

(51) Int. Cl.
*F23R 3/28* (2006.01)

(52) U.S. Cl.
CPC ..... *F23R 3/286* (2013.01)

(58) Field of Classification Search
CPC ..... F23R 3/20; F23R 3/30; F23R 3/36; F23R 3/46; F23R 3/286; F23R 3/346
USPC ..... 431/12, 278, 284, 585, 349, 350–353; 60/733, 737–739, 746, 747
See application file for complete search history.

(56) References Cited

U.S. PATENT DOCUMENTS 2,565,843 A * 8/1951 Dennison ..... 60/747
2,810,260 A * 10/1957 Fromm et al. ..... 60/738
3,012,802 A * 12/1961 Waite ..... 277/608
3,771,500 A 11/1973 Shakiba
4,100,733 A * 7/1978 Striebel et al. ..... 60/39.463
4,104,873 A 8/1978 Coffinberry
4,112,676 A * 9/1978 DeCorso ..... 60/733
4,262,482 A * 4/1981 Roffe et al. ..... 60/736
4,408,461 A * 10/1983 Bruhwiler et al. ..... 60/737
4,412,414 A 11/1983 Novick et al.
4,967,561 A * 11/1990 Bruhwiler et al. ..... 60/737
5,104,310 A 4/1992 Saltin
5,121,597 A * 6/1992 Urushidani et al. ..... 60/778
5,205,120 A 4/1993 Obländer et al.
5,213,494 A 5/1993 Jeppesen
5,235,814 A * 8/1993 Leonard ..... 60/738
5,263,325 A * 11/1993 McVey et al. ..... 60/738
5,339,635 A * 8/1994 Iwai et al. ..... 60/733
5,341,645 A 8/1994 Ansart et al.
5,439,532 A 8/1995 Fraas
5,592,819 A 1/1997 Ansart et al.
5,609,467 A * 3/1997 Lenhart et al. ..... 415/142
5,707,591 A 1/1998 Semedard et al.
5,881,756 A * 3/1999 Abbasi et al. ..... 137/9
6,098,407 A 8/2000 Korzendorfer et al.
6,123,542 A 9/2000 Joshi et al.
6,394,791 B2 5/2002 Smith et al.

(Continued)

OTHER PUBLICATIONS

Search Report and Written Opinion from EP Application No. 12192117.5 dated Feb. 26, 2013.

*Primary Examiner* — Jorge Pereiro
(74) *Attorney, Agent, or Firm* — Dority & Manning, PA

(57) ABSTRACT

A combustor includes a casing that surrounds at least a portion of the combustor and includes an end cover at one end of the combustor. An end cap axially separated from the end cover is configured to extend radially across at least a portion of the combustor and includes an upstream surface axially separated from a downstream surface. A plurality of tubes extends from the upstream surface through the downstream surface to provide fluid communication through the end cap. A cap shield extends axially from the end cover and circumferentially surrounds and supports the end cap.

18 Claims, 6 Drawing Sheets

(56) References Cited

U.S. PATENT DOCUMENTS

| | | | | |
|---|---|---|---|---|
| 6,438,961 | B2 | 8/2002 | Tuthill et al. | |
| 6,662,564 | B2 * | 12/2003 | Bruck et al. | 60/723 |
| 6,796,790 | B2 | 9/2004 | Venizelos et al. | |
| 6,983,600 | B1 | 1/2006 | Dinu et al. | |
| 7,003,958 | B2 | 2/2006 | Dinu et al. | |
| 7,007,478 | B2 | 3/2006 | Dinu | |
| 7,117,677 | B2 * | 10/2006 | Inoue et al. | 60/737 |
| 7,134,287 | B2 * | 11/2006 | Belsom et al. | 60/800 |
| 7,188,476 | B2 * | 3/2007 | Inoue et al. | 60/737 |
| 7,200,998 | B2 * | 4/2007 | Inoue et al. | 60/776 |
| 7,284,378 | B2 * | 10/2007 | Amond et al. | 60/776 |
| 7,313,919 | B2 * | 1/2008 | Inoue et al. | 60/737 |
| 7,343,745 | B2 * | 3/2008 | Inoue et al. | 60/737 |
| 7,469,544 | B2 * | 12/2008 | Farhangi | 60/740 |
| 7,516,607 | B2 * | 4/2009 | Farhangi et al. | 60/39.11 |
| 7,631,499 | B2 | 12/2009 | Bland | |
| 7,752,850 | B2 | 7/2010 | Laster et al. | |
| 7,762,074 | B2 * | 7/2010 | Bland et al. | 60/752 |
| 7,841,180 | B2 * | 11/2010 | Kraemer et al. | 60/723 |
| 8,225,591 | B2 * | 7/2012 | Johnson et al. | 60/39.092 |
| 8,234,871 | B2 * | 8/2012 | Davis et al. | 60/737 |
| 8,550,809 | B2 * | 10/2013 | Uhm et al. | 431/8 |
| 8,662,502 | B2 * | 3/2014 | Stoia et al. | 277/572 |
| 2002/0083711 | A1 * | 7/2002 | Dean et al. | 60/737 |
| 2004/0216463 | A1 | 11/2004 | Harris | |
| 2007/0227148 | A1 * | 10/2007 | Bland et al. | 60/752 |
| 2008/0016876 | A1 | 1/2008 | Colibaba-Evulet et al. | |
| 2008/0304958 | A1 | 12/2008 | Norris et al. | |
| 2009/0173075 | A1 * | 7/2009 | Miura et al. | 60/737 |
| 2009/0293484 | A1 * | 12/2009 | Inoue et al. | 60/740 |
| 2009/0293489 | A1 | 12/2009 | Tuthill et al. | |
| 2009/0297996 | A1 | 12/2009 | Vatsky et al. | |
| 2010/0008179 | A1 | 1/2010 | Lacy et al. | |
| 2010/0024426 | A1 | 2/2010 | Varatharajan et al. | |
| 2010/0031662 | A1 | 2/2010 | Zuo | |
| 2010/0060391 | A1 | 3/2010 | Ristola et al. | |
| 2010/0084490 | A1 | 4/2010 | Zuo et al. | |
| 2010/0089367 | A1 | 4/2010 | Johnson et al. | |
| 2010/0095676 | A1 | 4/2010 | Uhm et al. | |
| 2010/0139280 | A1 | 6/2010 | Lacey et al. | |
| 2010/0186413 | A1 | 7/2010 | Lacey et al. | |
| 2010/0192581 | A1 | 8/2010 | Ziminsky et al. | |
| 2010/0218501 | A1 | 9/2010 | York et al. | |
| 2010/0236247 | A1 * | 9/2010 | Davis et al. | 60/742 |
| 2010/0252652 | A1 | 10/2010 | Johnson et al. | |
| 2010/0275601 | A1 * | 11/2010 | Berry et al. | 60/737 |
| 2010/0287942 | A1 | 11/2010 | Zuo et al. | |
| 2011/0000215 | A1 * | 1/2011 | Lacy et al. | 60/746 |
| 2011/0016871 | A1 | 1/2011 | Kraemer et al. | |
| 2011/0072824 | A1 | 3/2011 | Zuo et al. | |
| 2011/0073684 | A1 | 3/2011 | Johnson et al. | |
| 2011/0083439 | A1 | 4/2011 | Zuo et al. | |
| 2011/0089266 | A1 * | 4/2011 | Stoia et al. | 239/533.2 |
| 2011/0089267 | A1 * | 4/2011 | Stoia et al. | 239/589 |
| 2011/0113783 | A1 | 5/2011 | Boardman et al. | |
| 2012/0055167 | A1 * | 3/2012 | Johnson et al. | 60/776 |
| 2012/0279223 | A1 * | 11/2012 | Barker et al. | 60/740 |
| 2013/0074503 | A1 * | 3/2013 | Rohrssen et al. | 60/740 |
| 2013/0074510 | A1 * | 3/2013 | Berry | 60/772 |
| 2013/0084534 | A1 * | 4/2013 | Melton et al. | 431/2 |
| 2013/0101943 | A1 * | 4/2013 | Uhm et al. | 431/8 |
| 2013/0104556 | A1 * | 5/2013 | Uhm et al. | 60/772 |
| 2013/0115561 | A1 * | 5/2013 | Melton et al. | 431/8 |

* cited by examiner

COMBUSTOR

FIELD OF THE INVENTION

The present invention generally involves a combustor.

BACKGROUND OF THE INVENTION

Combustors are commonly used in industrial and power generation operations to ignite fuel to produce combustion gases having a high temperature and pressure. Various competing considerations influence the design and operation of combustors. For example, higher combustion gas temperatures generally improve the thermodynamic efficiency of the combustor. However, higher combustion gas temperatures also promote flashback or flame holding conditions in which the combustion flame migrates towards the fuel being supplied by nozzles, possibly causing severe damage to the nozzles in a relatively short amount of time. In addition, higher combustion gas temperatures generally increase the disassociation rate of diatomic nitrogen, increasing the production of nitrogen oxides ($NO_x$). Conversely, lower combustion gas temperatures associated with reduced fuel flow and/or part load operation (turndown) generally reduce the chemical reaction rates of the combustion gases, increasing the production of carbon monoxide and unburned hydrocarbons.

In a particular combustor design, an end cap may extend radially across a portion of the combustor, and a plurality of tubes may be radially arranged in the end cap to provide fluid communication through the end cap and into a combustion chamber. A working fluid and fuel are supplied through the tubes to enhance mixing between the working fluid and fuel before reaching the combustion chamber. The enhanced mixing allows leaner combustion at higher operating temperatures while protecting against flashback or flame holding and controlling undesirable emissions. However, some fuels supplied to the tubes produce vibrations in the combustor that may lead to harmful combustion dynamics. The combustion dynamics may reduce the useful life of one or more combustor components. Alternately, or in addition, the combustion dynamics may produce pressure pulses inside the tubes and/or combustion chamber that affect the stability of the combustion flame, reduce the design margins for flashback or flame holding, and/or increase undesirable emissions. In addition to combustion dynamics, other common sources of vibration in the combustor may be caused by rotor vibrations, rotating blade frequencies, and flow induced vibrations associated with vortex shedding.

Various efforts have been made to reduce the vibrations produced by fluid flow through the end cap. For example, various structures and methods have been developed to prevent or avoid harmonic frequencies from being created in the combustor. Alternately or in addition, the volume or geometry of the combustor may be adjusted to change the natural or resonant frequency of components in the combustor; however, the change in volume or geometry may adversely affect the mixing between the fuel and working fluid. As an alternative or additional approach, increasing the natural or resonant frequency of the end cap in the combustor may be useful to avoiding harmonic frequencies in the combustor and the associated undesirable combustor dynamics.

BRIEF DESCRIPTION OF THE INVENTION

Aspects and advantages of the invention are set forth below in the following description, or may be obvious from the description, or may be learned through practice of the invention.

One embodiment of the present invention is a combustor that includes a casing that surrounds at least a portion of the combustor and includes an end cover at one end of the combustor. An end cap axially separated from the end cover is configured to extend radially across at least a portion of the combustor and includes an upstream surface axially separated from a downstream surface. A plurality of tubes extends from the upstream surface through the downstream surface to provide fluid communication through the end cap. A cap shield extends axially from the end cover and circumferentially surrounds and supports the end cap.

Another embodiment of the present invention is a combustor that includes a casing that surrounds at least a portion of the combustor. An end cap axially separated from the end cover is configured to extend radially across at least a portion of the combustor and includes an upstream surface axially separated from a downstream surface. A cap shield that circumferentially surrounds at least a portion of the upstream and downstream surfaces. A plurality of tubes extends from the upstream surface through the downstream surface to provide fluid communication through the end cap. A plurality of supports connects to the end cap, and each support extends radially between the end cap and the casing to support the end cap.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
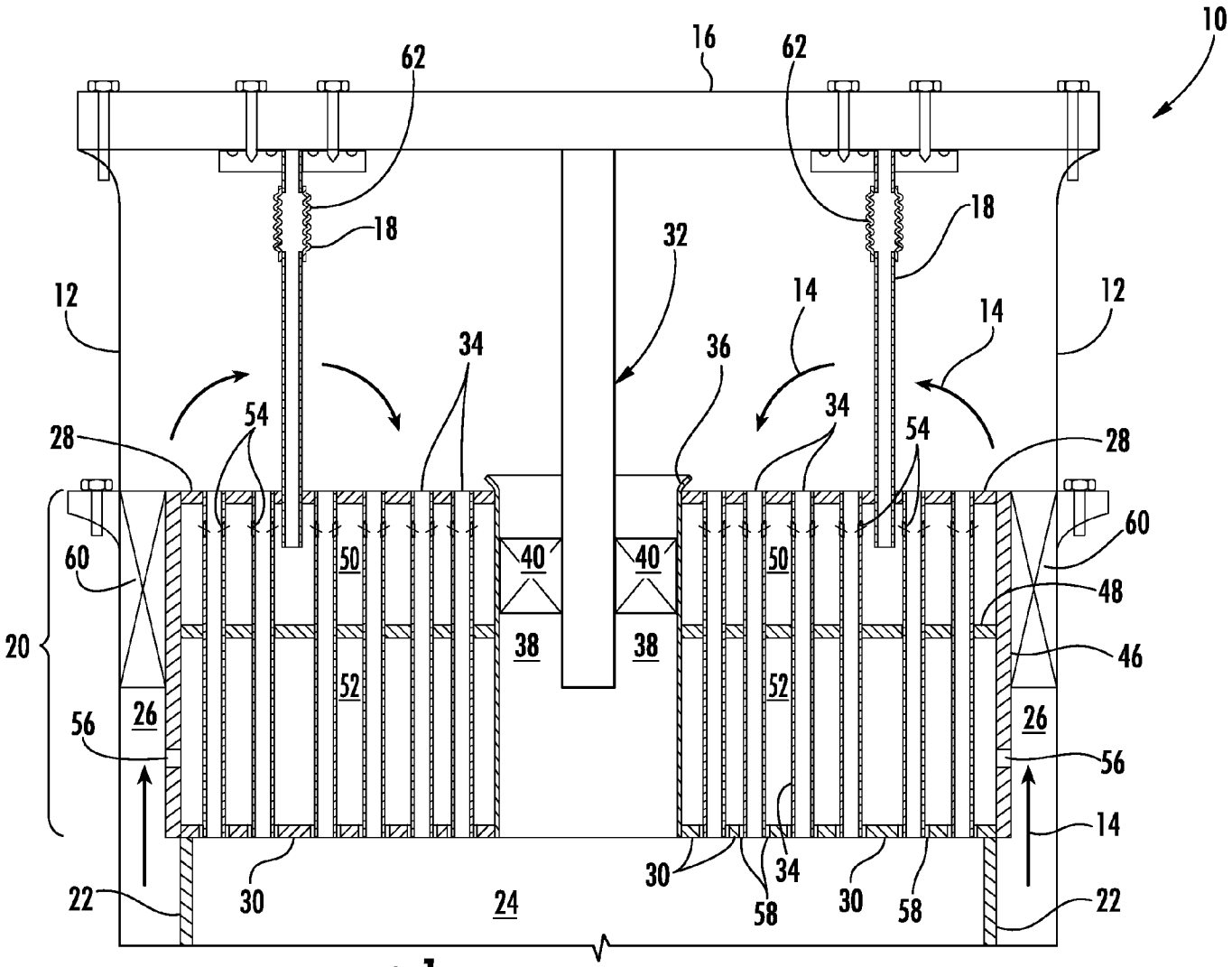
FIG. 1 is a simplified cross-section view of an exemplary combustor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a combustor that generally includes a casing that encloses a working fluid flowing though the combustor. A plurality of tubes radially arranged in an end cap enhances mixing between the working fluid and fuel prior to combustion. In particular embodiments, one or more supports may extend radially and/or axially from the end cap to brace the end cap against the casing. The additional bracing provided by the supports tends to increase the natural or resonant frequency of the end cap to reduce and/or prevent vibration sources from exciting and subsequently damaging components in the combustor. As a result, various embodiments of the present invention may allow extended combustor operating conditions, extend the life and/or maintenance intervals for various combustor components, maintain adequate design margins of flashback or flame holding, and/or reduce undesirable emissions. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

Figure 2:
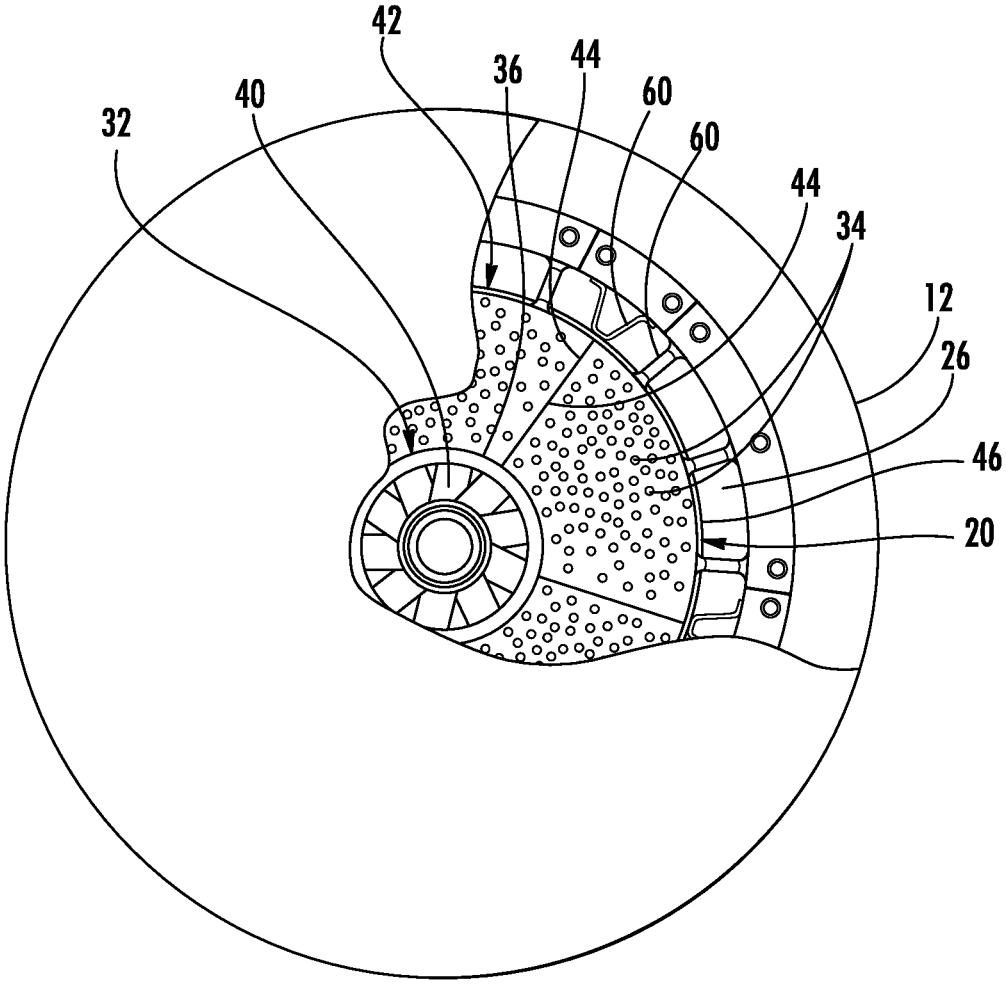
FIG. 2 is an upstream axial view of the combustor shown in FIG. 1 according to an embodiment of the present invention.

FIG. 1 provides a simplified cross-section view of an exemplary combustor 10 according to one embodiment of the present invention, and FIG. 2 provides an upstream axial view of the combustor 10 shown in FIG. 1. As shown, a casing 12 generally surrounds the combustor 10 to contain a working fluid 14 flowing to the combustor 10. The casing 12 may include an end cover 16 at one end to provide an interface for supplying fuel, diluent, and/or other additives to the combustor 10. One or more fluid conduits 18 may extend axially from the end cover 16 to an end cap 20 to provide fluid communication for the fuel, diluent, and/or other additives to the end cap 20. Possible diluents may include, for example, water, steam, working fluid, air, fuel additives, various inert gases such as nitrogen, and/or various non-flammable gases such as carbon dioxide or combustion exhaust gases supplied to the combustor 10. The end cap 20 is configured to extend radially across at least a portion of the combustor 10, and the end cap 20 and a liner 22 generally define a combustion chamber 24 downstream from the end cap 20. The casing 12 circumferentially surrounds the end cap 20 and/or the liner 22 to define an annular passage 26 that surrounds the end cap 20 and liner 22. In this manner, the working fluid 14 may flow through the annular passage 26 along the outside of the liner 22 to provide convective cooling to the liner 22. When the working fluid 14 reaches the end cover 16, the working fluid 14 may reverse direction to flow through the end cap 20 and into the combustion chamber 24.

As shown in FIGS. 1 and 2, the end cap 20 generally includes an upstream surface 28 axially separated from a downstream surface 30, and one or more nozzles 32 and/or tubes 34 may extend from the upstream surface 28 through the downstream surface 30 to provide fluid communication through the end cap 20. The particular shape, size, number, and arrangement of the nozzles 32 and tubes 34 may vary according to particular embodiments. For example, the nozzles 32 and tubes 34 are generally illustrated as having a cylindrical shape; however, alternate embodiments within the scope of the present invention may include nozzles and tubes having virtually any geometric cross-section.

The nozzle 32 may extend axially from the end cover 16 through the end cap 20. A shroud 36 may circumferentially surround the nozzle 32 to define an annular passage 38 around the nozzle 32 and provide fluid communication through the end cap 20. The working fluid 14 may thus flow through the annular passage 38 and into the combustion chamber 24. In addition, the nozzle 32 may supply fuel, diluent, and/or other additives to the annular passage 38 to mix with the working fluid 14 before entering the combustion chamber 24. One or more vanes 40 may extend radially between the nozzle 32 and the shroud 36 to impart swirl to the fluids flowing through the annular passage 38 to enhance mixing of the fluids before reaching the combustion chamber 24.

The tubes 34 may be radially arranged across the end cap 20 in one or more tube bundles 42 of various shapes and sizes, with each tube bundle 42 in fluid communication with one or more fluid conduits 18. For example, as shown in FIG. 2, one or more dividers 44 may extend axially between the upstream and downstream surfaces 28, 30 to separate or group the tubes 34 into pie-shaped tube bundles 42 radially arranged around the nozzle 32. One or more fluid conduits 18 may provide one or more fuels, diluents, and/or other additives to each tube bundle 42, and the type, fuel content, and reactivity of the fuel and/or diluent may vary for each fluid conduit 18 or tube bundle 42. In this manner, different types, flow rates, and/or additives may be supplied to one or more tube bundles 42 to allow staged fueling of the tubes 34 over a wide range of operating conditions.

A cap shield 46 may circumferentially surround at least a portion of the upstream and downstream surfaces 28, 30 to at least partially define one or more plenums inside the end cap 20 between the upstream and downstream surfaces 28, 30. For example, as shown most clearly in FIG. 1, a barrier 48 may extend radially inside the end cap 20 between the upstream and downstream surfaces 28, 30 to at least partially define a fuel plenum 50 and a diluent plenum 52 inside the end cap 20. Specifically, the upstream surface 28, cap shield 46, and barrier 48 may define the fuel plenum 50, and the downstream surface 30, cap shield 46, and barrier 48 may define the diluent plenum 52. One or more of the tubes 34 may include a fuel port 54 that provides fluid communication from the fuel plenum 50 into the tubes 34. The fuel ports 54 may be angled radially, axially, and/or azimuthally to project and/or impart swirl to the fuel flowing through the fuel ports 54 and into the tubes 34. Similarly, the cap shield 46 may include one or more diluent ports 56 that provide fluid communication from the annular passage 26 through the cap shield 46 and into the diluent plenum 52. In this manner, fuel from the fluid conduit 18 may flow into the end cap 20 and around the tubes 34 in the fuel plenum 50 to provide convective cooling to the tubes 34 before flowing through the fuel ports 54 and mixing with the working fluid flowing through the tubes 34. In addition, at least a portion of the compressed working fluid 14 may flow from the annular passage 26 through the cap shield 46 and into the diluent plenum 52 to provide convective cooling to the tubes 34. The working fluid 14 may then flow through one or more diluent passages 58 in the downstream surface 30 and into the combustion chamber 24.

As shown most clearly in FIG. 1, the fluid conduits 18 and/or nozzle 32 provide a cantilevered attachment between the end cap 20 and the end cover 16. The cantilevered attachment results in a resonant or natural frequency associated with the end cap 20 that may be in the frequency range of other vibrations sources, causing harmonic vibrations at specific flow rates that may lead to damage and/or increased wear. As a result, a plurality of supports 60 may connect to the end cap 20 and extend radially between the end cap 20 and the casing 12. In this manner, the supports 60 brace the end cap 20 and raise the resonant or natural frequency associated with the end cap 20 to reduce the possibility of harmonic vibrations existing in the combustor 10. As shown most clearly in FIG. 2, one or more of the supports 60 may be radially aligned with the divider 44, while other supports 60 may be radially offset from the divider 44 to enhance the structural support and/or bracing provided to the end cap 20 while also achieving a higher desired resonant or natural frequency.

The temperature of the fuel and working fluid flowing around and through the combustor 10 may vary considerably during operations, causing the casing 12, fluid conduits 18, and/or tubes 34 to expand or contract at different rates and by different amounts. As a result, a flexible coupling 62 may be included in one or more fluid conduits 18 between the end cover 16 and the end cap 20. The flexible coupling 62 may include one or more expansion joints or bellows that accommodate axial displacement by the casing 12, tubes 34, and/or conduits 18 caused by thermal expansion or contraction. One of ordinary skill in the art will readily appreciate that alternate locations and/or combinations of flexible couplings 62 are within the scope of various embodiments of the present invention, and the specific location or number of flexible couplings 62 is not a limitation of the present invention unless specifically recited in the claims.

Figure 3:
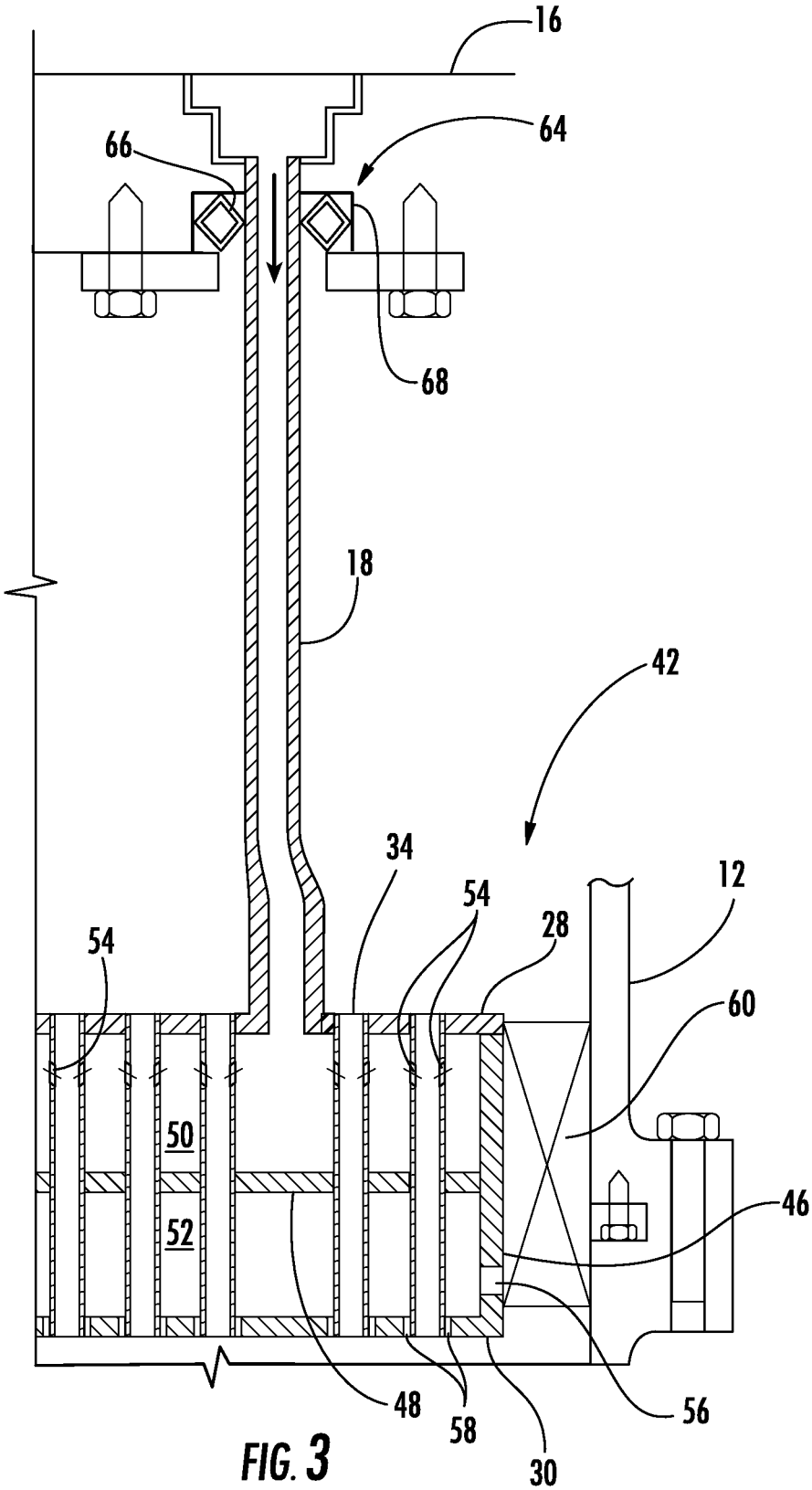
FIG. 3 is an enlarged cross-section view of a tube bundle shown in FIG. 1 according to an alternate embodiment of the present invention.

FIG. 3 provides an enlarged cross-section view of a tube bundle 42 shown in FIG. 1 according to an alternate embodiment of the present invention. As shown, the tube bundle 42 again includes an end cap 20 having upstream and downstream surfaces 28, 30 and tubes 34. A cap shield 46 and a barrier 48 again partially define fuel and diluent plenums 50, 52 inside the end cap 20, and fuel and diluent ports 54, 56 provide fluid communication through the end cap 20 as previously described with respect to the embodiment shown in FIGS. 1 and 2. In addition, the one or more supports 60 again extend radially between the end cap 20 and the casing 12 to brace the end cap 20 and raise the resonant or natural frequency associated with the end cap 20.

In the particular embodiment shown in FIG. 3, however, the flexible coupling 62 shown in FIG. 1 has been replaced with a flexible seal 64 between the fluid conduit 18 and the end cover 16. The flexible seal 64 allows axial displacement of the conduit 18 relative to the end cover 16 caused by thermal expansion or contraction of the casing 12, tubes 34, and/or conduit 18. As shown in FIG. 3, the flexible seal 64 may include a lip seal 66 positioned in a groove 68 that surrounds the fluid conduit 18 passing through the end cover 16. The compression of the lip seal 66 provides a seal that prevents the working fluid 14 from leaking past the end cover 16 while also allowing axial expansion and contraction of the fluid conduit 18.

Figure 4:
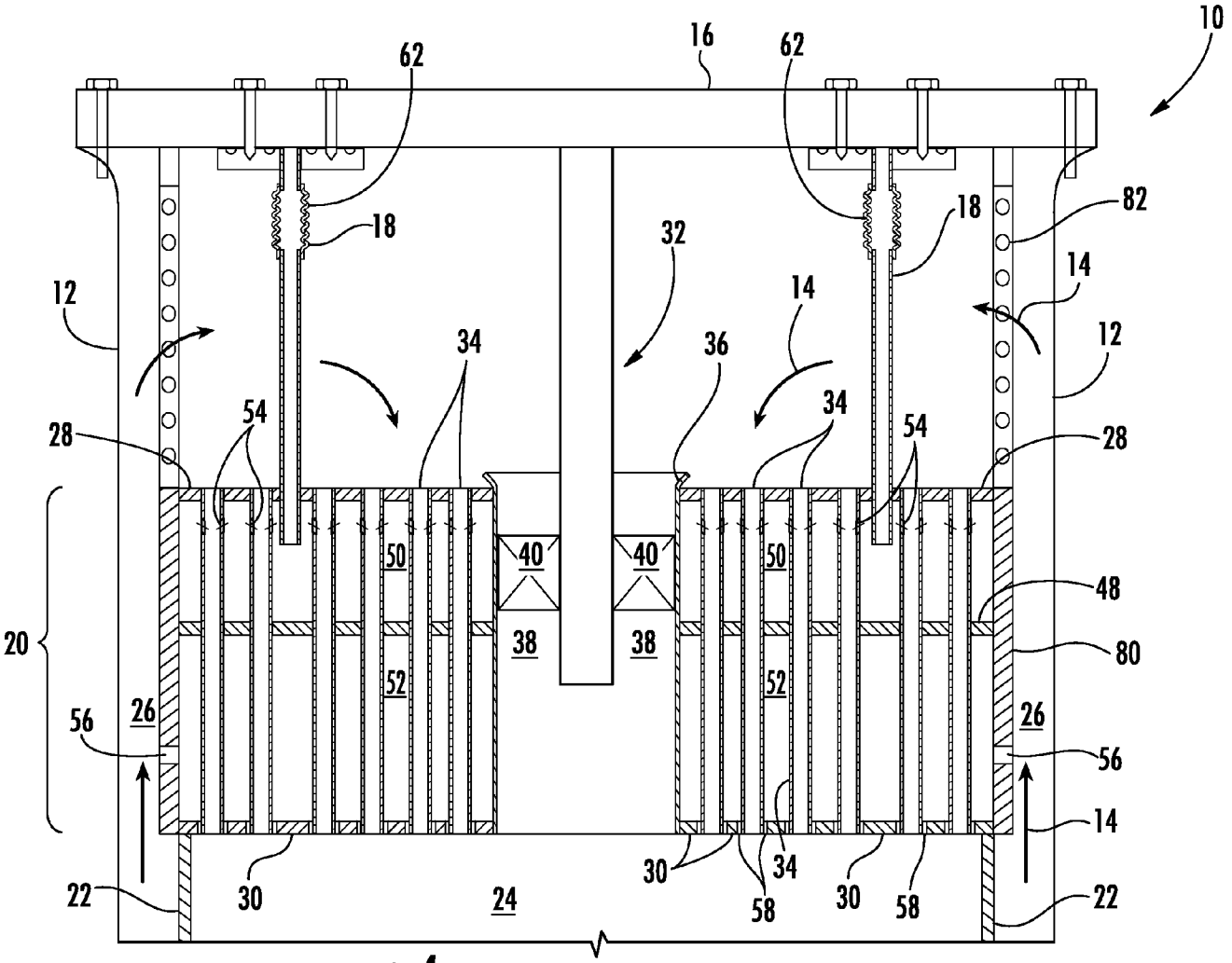
FIG. 4 is a simplified cross-section view of an exemplary combustor according to an alternate embodiment of the present invention.
Figure 5:
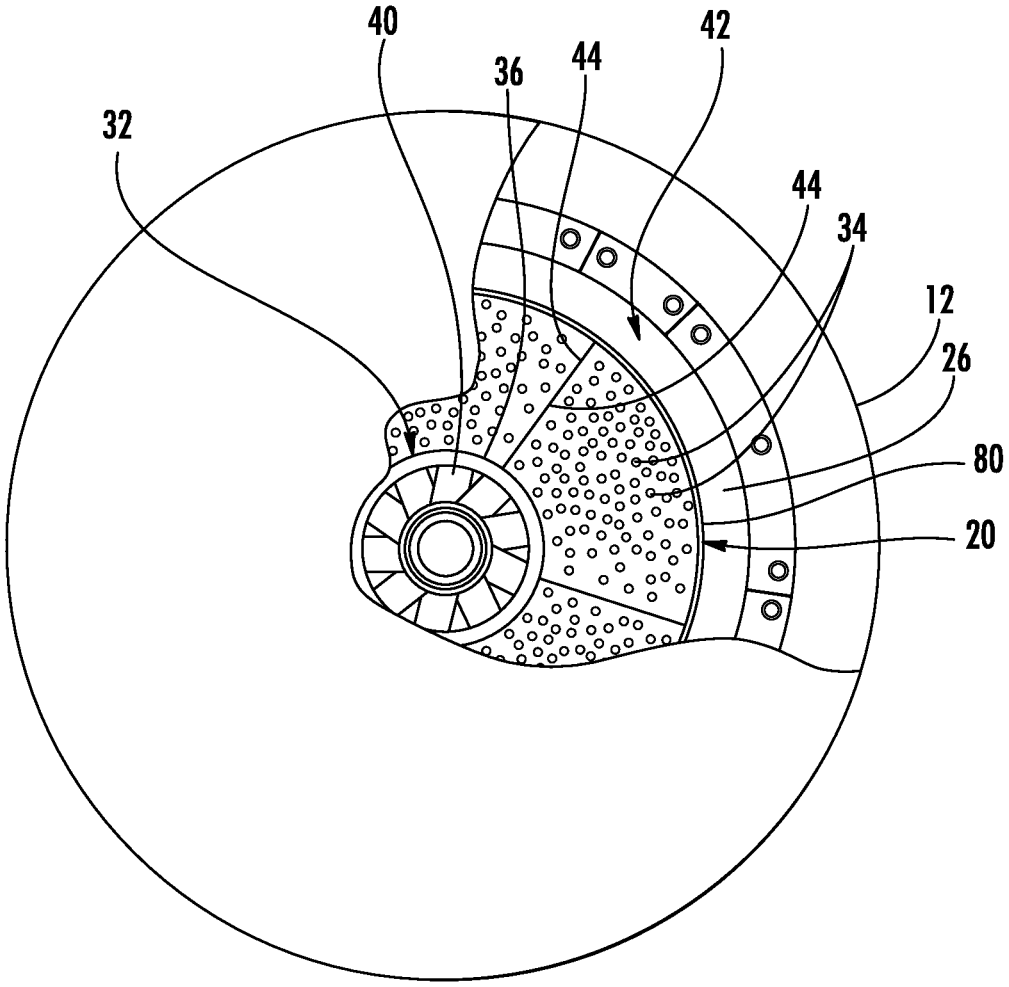
FIG. 5 is an upstream axial view of the combustor shown in FIG. 4 according to an embodiment of the present invention.

FIG. 4 provides a simplified cross-section view of an exemplary combustor 10 according to an alternate embodiment of the present invention, and FIG. 5 provides an upstream axial view of the combustor 10 shown in FIG. 4 according to an embodiment of the present invention. As shown, the combustor 10 again includes a casing 12, end cover 16, conduits 18, end cap 20, liner 22, combustion chamber 24, nozzle 32, and tubes 34 as previously described with respect to the embodiment shown in FIGS. 1-3, and further description of these components is not necessary. In this particular embodiment, however, the support is a cap shield 80 that extends axially from the end cover 16 and circumferentially surrounds and supports the end cap 20. As shown most clearly in FIG. 4, the cap shield 80 includes a plurality of openings 82 between the end cover 16 and the end cap 20 to allow fluid flow across the cap shield 80 between the end cover 16 and the end cap 20. In this manner, the cap shield 80 braces the end cap 20 and raises the resonant or natural frequency associated with the end cap 20 to reduce the possibility of harmonic vibrations existing in the combustor 10.

As shown in FIG. 4, the fluid conduit 18 may again include a flexible coupling 62 between the end cover 16 and the end cap 20 to accommodate axial displacement by the casing 12, tubes 34, and/or conduits 18 caused by thermal expansion or contraction. Alternately, or in addition, as shown in FIG. 6, a flexible seal 64 between the fluid conduit 18 and the end cover 16 may allow axial displacement of the conduit 18 relative to the end cover 16 caused by thermal expansion or contraction of the casing 12, tubes 34, and/or conduit 18.

Figure 6:
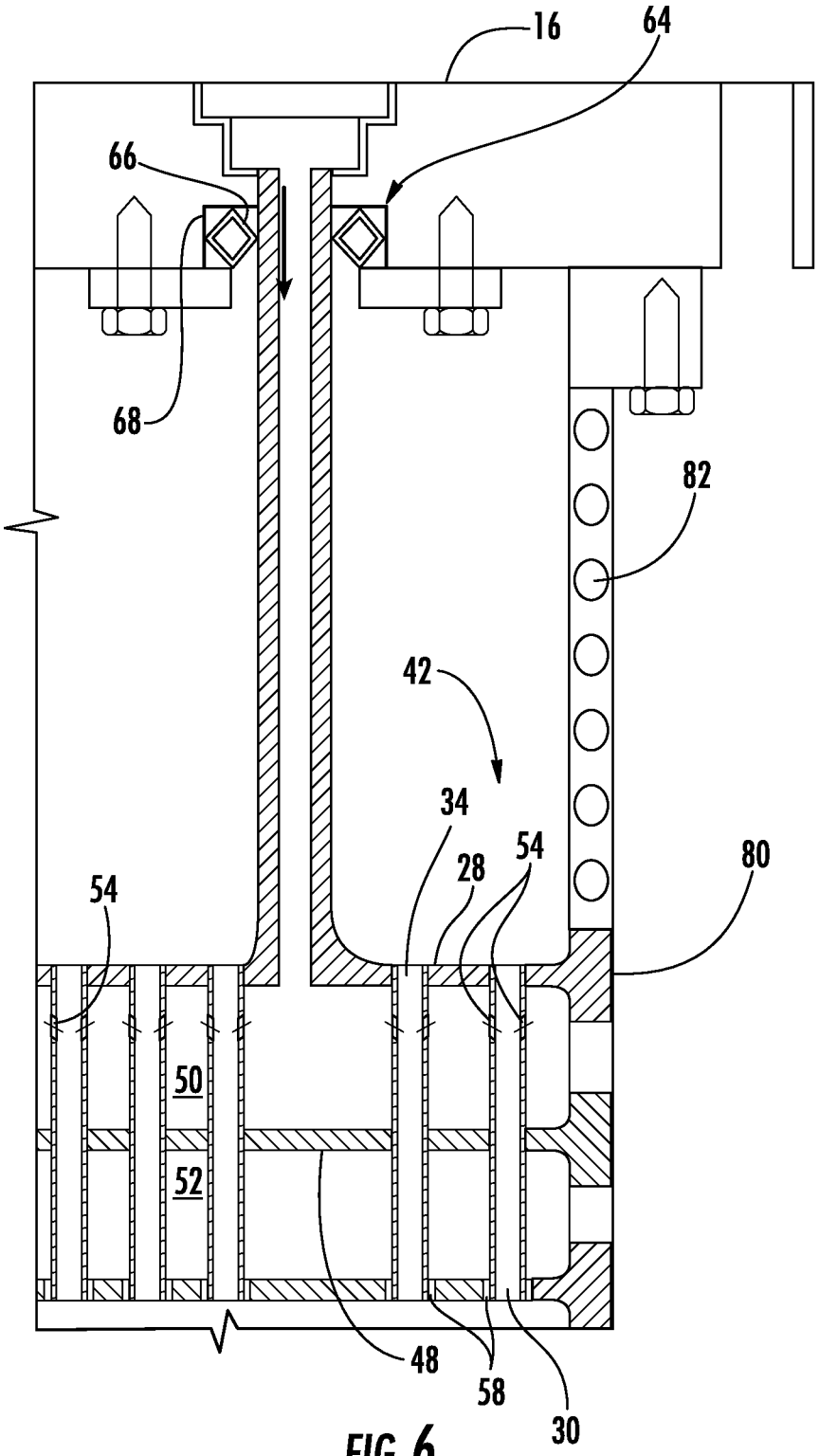
FIG. 6 is an enlarged cross-section view of a tube bundle shown in FIG. 4 according to an alternate embodiment of the present invention.

FIG. 6 provides an enlarged cross-section view of a tube bundle 42 shown in FIG. 4 according to an alternate embodiment of the present invention. As shown, the tube bundle 42 again includes an end cap 20 having upstream and downstream surfaces 28, 30 and tubes 34. A cap shield 46 and a barrier 48 again partially define fuel and diluent plenums 50, 52 inside the end cap 20, and fuel and diluent ports 54, 56 provide fluid communication through the end cap 20 as previously described with respect to the embodiment shown in FIGS. 1 and 2. In addition, the cap shield 80 again extends axially from the end cover 16 and circumferentially surrounds and supports the end cap 20 to raise the resonant or natural frequency associated with the end cap 20.

In the particular embodiment shown in FIG. 6, however, the flexible coupling 62 shown in FIG. 4 has been replaced with a flexible seal 64 between the fluid conduit 18 and the end cover 16. The flexible seal 64 allows axial displacement of the conduit 18 relative to the end cover 16 caused by thermal expansion or contraction of the casing 12, tubes 34, and/or conduit 18. As shown in FIG. 6, the flexible seal 64 may include a lip seal 66 positioned in a groove 68 that surrounds the fluid conduit 18 passing through the end cover 16. The compression of the lip seal 66 provides a seal that prevents the working fluid 14 from leaking past the end cover 16 while also allowing axial expansion and contraction of the fluid conduit 18.

The various embodiments shown and described with respect to FIGS. 1-6 provide one or more commercial and/or technical advantages over previous combustors. For example, the supports 60 shown in FIGS. 1-3 and/or the cap shield 80 shown in FIGS. 4-6 produce a higher resonant or natural frequency associated with the end cap 20. The higher resonant or natural frequency of the end cap 20 allows for a larger volume upstream from the combustion chamber 24 than previously provided. The larger volume upstream from the combustion chamber 24 allows more time for the fuel and working fluid 14 to mix prior to combustion which allows for leaner and higher temperature combustion without increasing emissions.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor, comprising:

a. a casing that surrounds at least a portion of the combustor, wherein the casing includes an end cover at one end of the combustor;

b. an end cap axially separated from the end cover, wherein the end cap is configured to extend radially across at least a portion of the combustor and includes an upstream surface axially separated from a downstream surface;

c. a plurality of tubes that extends from the upstream surface through the downstream surface to provide fluid communication through the end cap; and d. a cap shield that extends axially from the end cover, wherein the cap shield circumferentially surrounds the upstream surface and the downstream surface of the end cap, the upstream surface and the cap shield at least partially defining a fuel plenum within the end cap, wherein the cap shield is connected to the end cover and supports the end cap.

2. The combustor as in claim 1, wherein the cap shield includes a plurality of openings defined between the end cover and the upstream surface of the end cap, the openings providing for fluid flow through the cap shield upstream from the upstream surface.

3. The combustor as in claim 1, further comprising a conduit that extends axially from the end cover to the end cap, wherein the conduit provides fluid communication from the end cover to the end cap.

4. The combustor as in claim 3, further comprising a flexible coupling in the conduit between the end cover and the end cap.

5. The combustor as in claim 3, further comprising a flexible seal between the conduit and the end cover.

6. The combustor as in claim 1, further comprising a barrier that extends radially inside the cap shield between the upstream and downstream surfaces to at least partially define the fuel plenum and a diluent plenum inside the end cap.

7. The combustor as in claim 6, further comprising a plurality of fuel ports through the plurality of tubes, wherein the plurality of fuel ports provides fluid communication from the fuel plenum into the plurality of tubes.

8. The combustor as in claim 6, further comprising a plurality of diluent ports through the cap shield, wherein the plurality of diluent ports provides fluid communication into the diluent plenum.

9. The combustor as in claim 1, further comprising a divider that extends axially inside the end cap from the upstream surface to the downstream surface, wherein the divider separates the plurality of tubes into a plurality of tube bundles.

10. The combustor as in claim 1, further comprising a fuel nozzle that extends axially from the end cover through the end cap.

11. A combustor, comprising:

a. a casing that surrounds at least a portion of the combustor;

b. an end cap downstream from the end cover, wherein the end cap is configured to extend radially across at least a portion of the combustor and includes an upstream surface axially separated from a downstream surface;

c. a cap shield that circumferentially surrounds at least a portion of the upstream and downstream surfaces the upstream surface and the cap shield at least partially defining a fuel plenum within the end cap;

d. a plurality of tubes that extends from the upstream surface through the fuel plenum and through the downstream surface to provide fluid communication through the end cap;

e. a plurality of supports connected to the cap shield, wherein each support extends radially from the cap shield to the casing to support the end cap; and f. a conduit that extends downstream from the end cover and provides fluid communication from the end cover through the upstream surface and into the fuel plenum, wherein the conduit comprises a flexible coupling disposed between the end cover and the upstream surface of the end cap.

12. The combustor as in claim 11, further comprising a flexible seal between the conduit and the end cover.

13. The combustor as in claim 11, further comprising a barrier that extends radially inside the cap shield between the upstream and downstream surfaces to at least partially define the fuel plenum and a diluent plenum inside the end cap.

14. The combustor as in claim 13, further comprising a plurality of fuel ports through the plurality of tubes, wherein the plurality of fuel ports provides fluid communication from the fuel plenum into the plurality of tubes.

15. The combustor as in claim 11, further comprising a divider that extends axially inside the end cap from the upstream surface to the downstream surface, wherein the divider separates the plurality of tubes into a plurality of tube bundles.

16. The combustor as in claim 15, wherein one or more of the supports are radially aligned with the divider.

17. The combustor as in claim 15, wherein one or more of the supports are radially offset from the divider.

18. The combustor as in claim 11, further comprising a fuel nozzle that extends axially from the end cover through the end cap.

* * * * *